US005211534A

United States Patent [19]

Catlow

[11] Patent Number: 5,211,534

[45] Date of Patent: May 18, 1993

[54] BLADE TIP CLEARANCE CONTROL APPARATUS

[75] Inventor: Ronald Catlow, Derby, England

[73] Assignee: Rolls-Royce plc, London, England

[21] Appl. No.: 813,084

[22] Filed: Dec. 24, 1991

[30] Foreign Application Priority Data

Feb. 23, 1991 [GB] United Kingdom ..... 9103809

[51] Int. Cl.[5] ..... F01D 11/08

[52] U.S. Cl. ..... 415/173.002; 415/173.1; 415/173.3; 415/170.1; 415/174.2

[58] Field of Search ..... 415/170.1, 173.1, 173.2, 415/173.3, 174.2

[56] References Cited

U.S. PATENT DOCUMENTS

| | | | |
|---|---|---|---|
| 4,330,234 | 5/1982 | Colley | 415/173.2 |
| 4,596,116 | 6/1986 | Mandet et al. | 415/173.2 |
| 4,683,716 | 8/1987 | Wright et al. | 415/173.2 |
| 4,844,688 | 7/1989 | Clough et al. | 415/173.2 |
| 5,116,199 | 5/1992 | Ciokajlo | 415/173.2 |

FOREIGN PATENT DOCUMENTS

| | | | |
|---|---|---|---|
| 0152907 | 7/1986 | Japan | 415/174 |
| 0142808 | 6/1987 | Japan | 415/173.2 |
| 2016606 | 9/1979 | United Kingdom . | |
| 2068470 | 8/1981 | United Kingdom . | |
| 2103294 | 2/1983 | United Kingdom | 415/173.2 |
| 2195715 | 4/1988 | United Kingdom . | |
| 2235730 | 3/1991 | United Kingdom . | |
| 2240818 | 8/1991 | United Kingdom . | |

*Primary Examiner*—Edward K. Look
*Assistant Examiner*—Mark Sgantzos
*Attorney, Agent, or Firm*—Oliff & Berridge

[57] ABSTRACT

A blade clearance control apparatus (46) for a gas turbine engine (10) comprises a series of segments (42) which define a casing in the rotor path of high pressure shroudless turbine blades (30).

The segments (42) are attached to plates (78) having surfaces co-operating with chordal lengths (74) of a number of pressure tubes (68) which are located in a frame (46). The application and release of pressure to the pressure tubes (68) causes the segments (42) to move between inner and outer positions in order to control clearance X between the tips of blades (30) and the segments (42).

12 Claims, 4 Drawing Sheets

BLADE TIP CLEARANCE CONTROL APPARATUS

BACKGROUND OF THE INVENTION

1. Field of the Invention

The present invention relates to a blade tip clearance control apparatus for use with a gas turbine engine. In particular the invention is concerned with providing a clearance control apparatus for a gas turbine engine to control the clearance between a casing or static portion of the engine and the tips of turbine blades.

2. Description of the Related Art

It is important to keep the clearance between the tips of rotating blades and a static portion, such as the radially inner surface of an annular shroud, which surrounds the blade tips to a minimum. The clearance is controlled to minimize the leakage of turbine gases between the shroud and the blade tips. Minimizing the leakage of the turbine gases improves the engine efficiency and thereby reduces the specific fuel consumption of the engine.

During the conventional operating cycle of a gas turbine engine the turbine blades, and the discs on which they are mounted, expand due to centrifugal forces acting on them as they rotate at high speeds and by thermal expansion due to being heated by the working fluid passing therethrough. The annular shroud however is stationary and only expands due to being heated by the working fluid. Differential expansion occurs and the clearance between the blade tips and the shroud has to be controlled to give a minimum clearance at steady state conditions whilst ensuring that the blade tips do not rub on the shroud during transients.

SUMMARY OF THE INVENTION

The present invention seeks to provide a blade tip clearance control apparatus which provides an optimum clearance between the blade tips and the annular shroud during normal operating conditions and which maintains an adequate clearance during engine transients so that contact is substantially eliminated.

Accordingly to the present invention a gas turbine engine blade tip clearance control apparatus comprises a plurality of circumferentially arranged spaced wall members located adjacent the rotor path of a plurality of blades of the engine, each wall member being movable from a first radial stop to a second radial stop by an at least one pressure tube, the at least one pressure tube having a plurality of chordal lengths to which the wall members are operationally attached, the chordal lengths being preloaded to hold the wall members against the first radial stop, the pressure tube being pressurizable to deflect the chordal length and move the wall member to the second radial stop.

Preferably the chordal lengths are preloaded by being formed as a radiussed arc.

In the preferred embodiment of the present invention a plurality of equi-spaced pressure tubes are circumferentially arranged within a frame, each pressure tube has an at least one chordal length and the or each tube having end supports in the frame located between the or each chordal length, the wall members being operably connected to the tubes in the region of the respective chordal lengths. Preferably each pressure tube has three chordal lengths which are spaced apart.

The end support members may have an outer surface shaped to conform to the surface of the pressure tube when pressure is applied to the interior of the tube.

Each wall member can be attached to a plate supported against the respective pressure tube in the region of the respective chordal length by the end supports.

Each plate can be pre-loaded by being formed as a radiussed arc, the curvature of which corresponds to the respective chordal length, to hold the wall member against the first radial stop. The first radial stop is preferably radially outermost of the second radial stop.

Each pressure tube can have an air supply means connected by a switch to a source of pressurized air.

The switch can be controlled by a control of the engine.

BRIEF DESCRIPTION OF THE DRAWINGS

The present invention will now be more particularly described with reference to the accompanying drawings in which.

DETAILED DESCRIPTION OF THE PREFERRED EMBODIMENT

Figure 1:
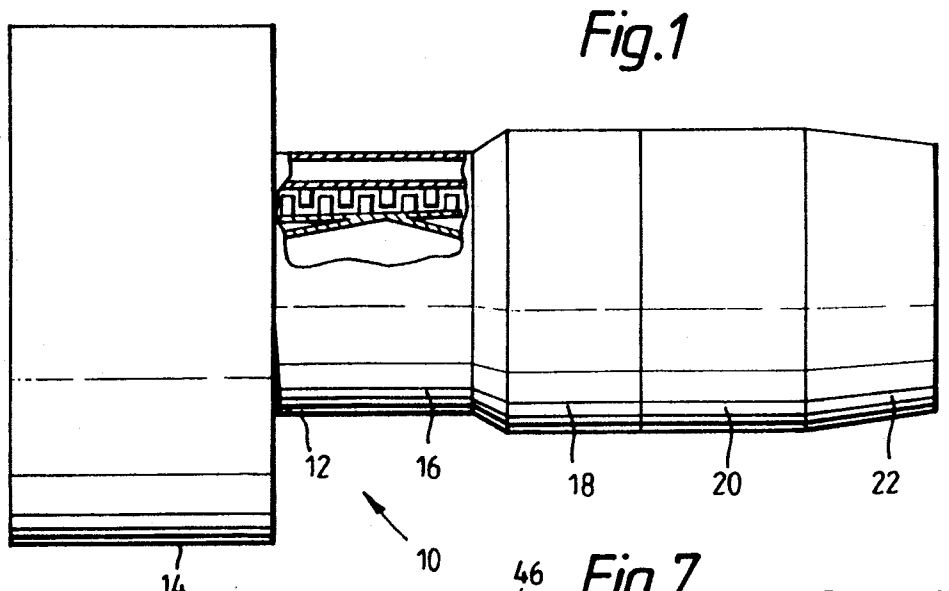
FIG. 1 shows a gas turbine engine incorporating a blade tip clearance control apparatus according to the present invention.
Figure 2:
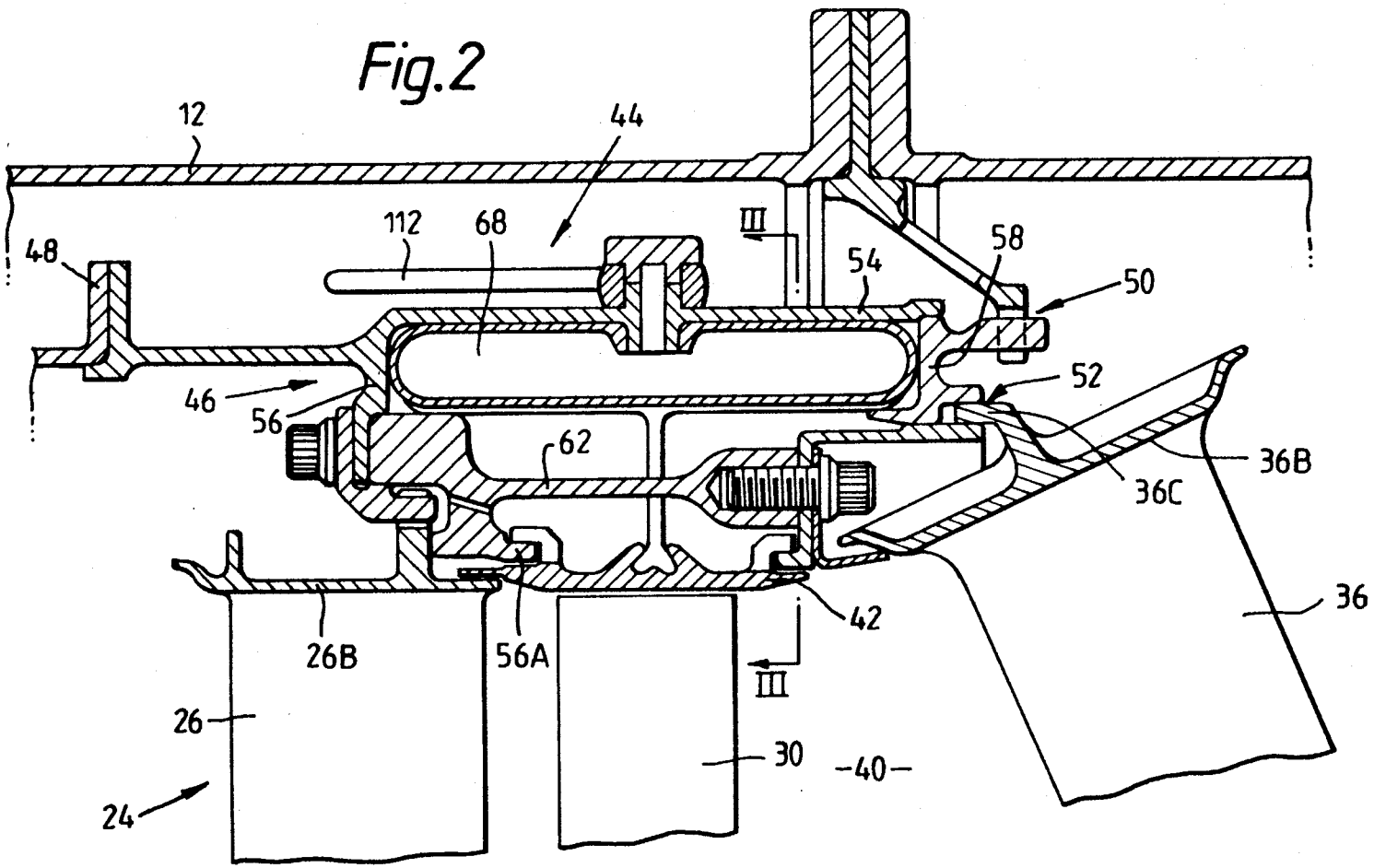
FIG. 2 is a sectional elevation of the blade tip clearance control apparatus of the engine shown in FIG. 1.

Referring to FIG. 1, a gas turbine engine 10 comprises a core engine contained within a casing 12. A fan (not shown) is driven by the core engine, the fan being contained within a fan casing 14 attached to the casing 12. The core engine comprises in flow series, a compressor 16, a combustor 18, a turbine 20 and an exhaust nozzle 22. The turbine 20 includes a high pressure turbine 24 (FIG. 2) having a ring of equi-spaced nozzle guide vanes 26 and a plurality of equi-spaced high pressure shroudless rotor blades 30. An array of outlet guide vanes 36 is located downstream of the rotor blades 30 and the vanes 36 are secured to a static structure (not shown). The vanes 26 and 36 and the rotor blades 30 all lie in an annular gas flow passage 40. The radially inner and outer walls of the passage 40 are defined by the platforms (not shown) and the outer shrouds 26B and 36B of the nozzle guide vanes 26 and outlet guide vanes 36 respectively.

Figure 4:
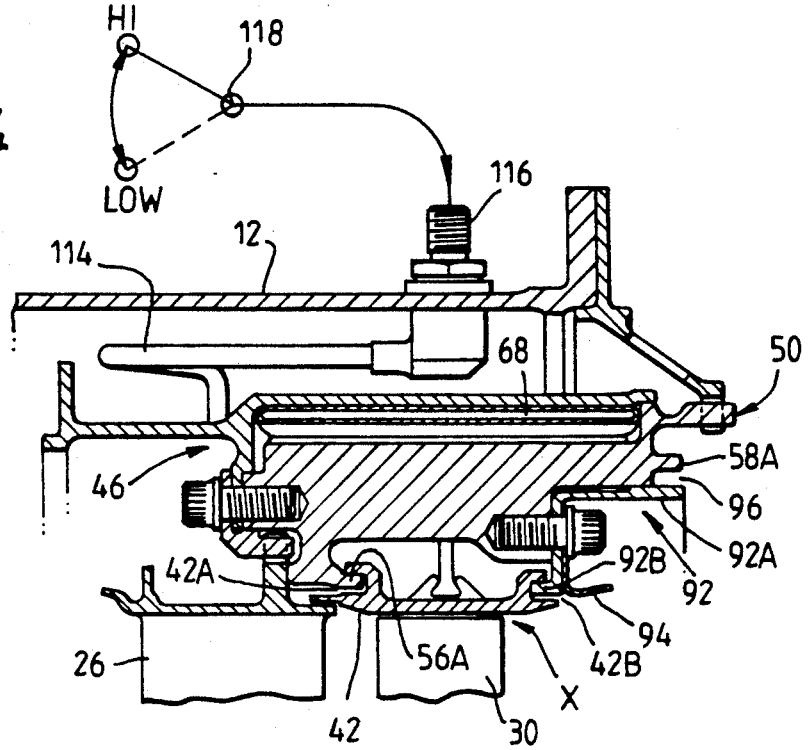
FIG. 4 is a section on line V—V in FIG. 3.

The blades 30 do not have outer shrouds and the part of the gas passage 40 in the plane of the rotor path of the blades 30 is defined by wall members in the form of a plurality of arc-shaped segments 42. The segments 42 form part of a blade tip clearance control apparatus indicated generally at 44. The function of the apparatus 44 is to control the clearance X (FIG. 4) between the tips of the blades 30 and the segments 42 in a predetermined controlled manner, as will be described below.

Figure 7:
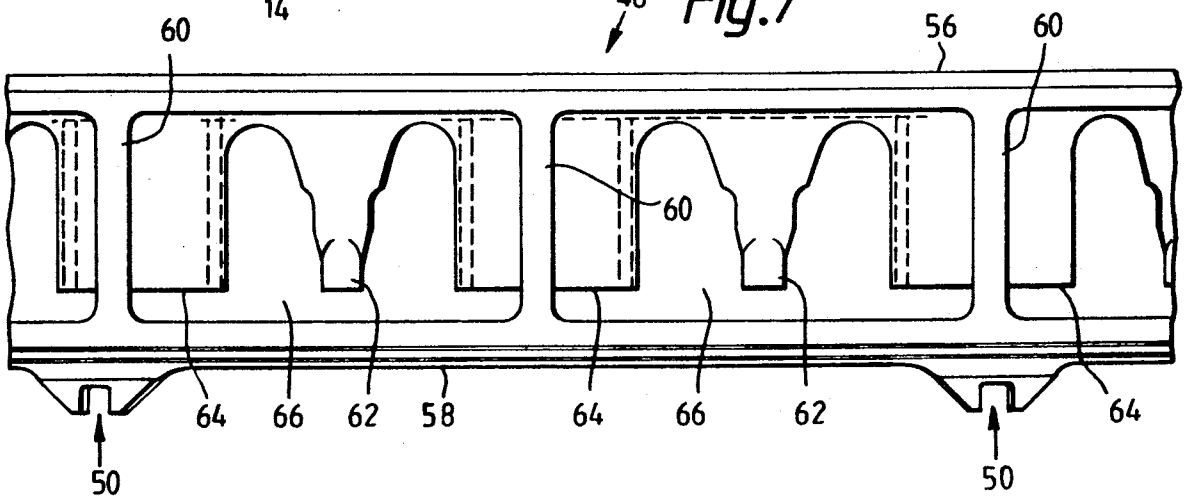
FIG. 7 is a view on arrow B in FIG. 3.

The apparatus 44 (FIG. 2) comprises a generally annular shaped cast frame 46 which is attached at its upstream end to an inner casing 48 of the engine 10 and is located downstream at positions 50 and 52 which locate the frame 46 radially and allow the frame 46 to move axially. The frame 46 is a cage like integral structure including an outer axially extending wall 54, upstream and downstream radially extending walls 56 and 58 respectively, a series of bars 60 (FIG. 7) which extend axially between the walls 56 and 58, radially inwardly of the wall 54, and a series of alternately arranged projections 62 and 64 which extend axially from the upstream wall 56 radially inwardly of the bars 60. The bars 60 define a number of equi-spaced openings 66.

Figure 3:
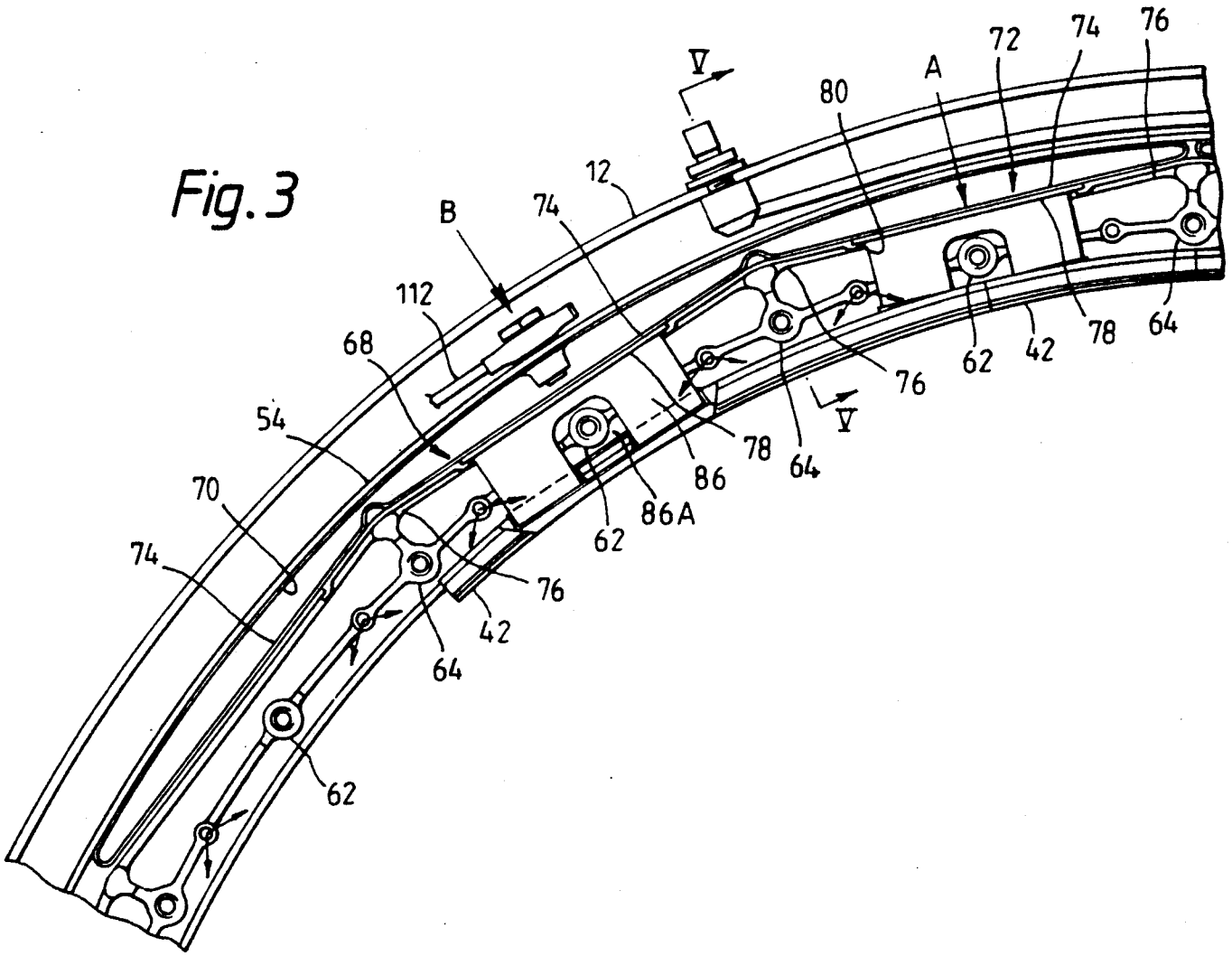
FIG. 3 is a section on line III—III in FIG. 2.

A series of pressure tubes 68 are located in the frame 46 between the outer wall 54, and the bars 60, (FIG. 3). Each pressure tube 68 has an arc-shaped outer wall 70 which bears against the inner surface of the wall 54 and an inner wall 72 which includes three equi-spaced chordal lengths 74.

The inner wall 72 is supported over the openings 66 by corner plates 76 and center plates 78. The center plates 78 are supported at their ends on lips 80 which are provided at the ends of each corner plate 76. The sides of the corner plates are supported on a shoulder of the upstream wall 56 and adjacent the edges of the openings 66.

The corner plates 76 are formed on their undersurface with a channel 82 (FIG. 5) having a central slot 84 which engages with a ridge on respective ones of the projection 64 allowing each corner plate 76 to pivot on the ridge. The center plates 78 are each aligned with one of the chordal lengths 74.

The inner wall 72 of each pressure tube 68 can take up either one of two positions depending upon the pressure applied to the interior of the tube 68. The inner wall 72 includes three equispaced chordal lengths 74. Each chordal length 74 is formed with a radiussed arc the curvature of which reverses when pressure is applied to the interior of each of the pressure tubes 68. The outer surface of each corner plate 76 is pre-formed to match that portion of the profile of the tube 68 when pressure is applied to the interior of the tube 68.

The outer surface of each center plate 78 is also formed with a radiussed arc corresponding to that of the chordal lengths 74. The curvature of the outer surface of each center plate 78 reverses when pressure is applied to the interior of each tube 68.

Figure 6:
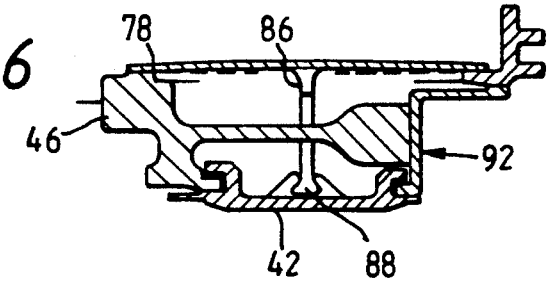
FIG. 6 is a section on line VII—VII in FIG. 5.

A hanger 86 (FIG. 6) is formed integrally with each center plate 78 and has a foot 88 which engages each segment 42 in order to retain the segments 42 to the clearance control apparatus 44. Each hanger 86 has an opening 86A (FIG. 3) to allow for the projection 62 and each segment 42 has arcuate upstream and downstream annular channels 42A and 42B respectively (see FIG. 4).

A rim 92 is attached to the frame 46 by bolts, and a static shroud 94 which defines part of the gas flow passage 40 is also secured in position by the bolts. The rim 92 has a flange 92A which co-operates with a flange 58A of the downstream wall 58 to form an annular channel 96 in which are located arcuate lips 36C (FIG. 2) of the outlet guide vanes 36. The frame 46 is thus supported radially and can move axially with respect to the fixed outlet guide vanes 36.

Figure 5:
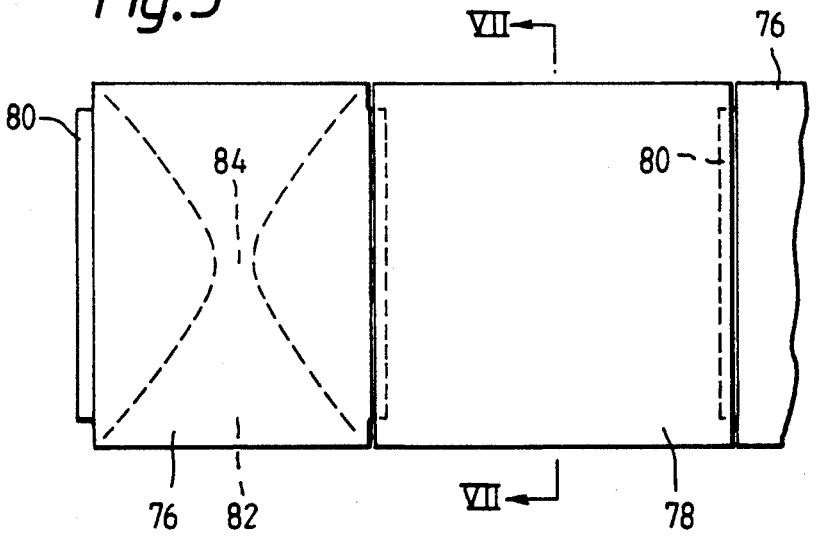
FIG. 5 is a view on arrow A in FIG. 3.

The upstream wall 56 has an annular lip 56A which engages with the upstream slot 42A in each segment 42. The engagement of the lip 56A in the slot 42A, and the gauge 92B in the slot 42B locates the segments 42 in the radial sense and allows the segments to move radially between inner and outer stop positions. In FIGS. 1 and 5 the segments 42 are shown in the inner stop position so that the clearance X is at a minimum. The outer stop position is defined by contact between the radially inner surfaces of the slots 42A and 42B and the radially inner surfaces of the lip 56A and flange 92B.

Each pressure tube 68 has an air supply pipe 112, each of which is connected to a common supply pipe 114, which terminates at a connector 116. Air supply from a suitable source, e.g. a tapping including a switch 118 from one of the stages of the engine compressor is attached to the connector 116.

The center plates 78 are pre-loaded on the frame 46 in an outward direction and hold the segments 42 against their outer stops. In this state the external surface of each center plate 78 is curved in the axial sense and in the case of a plate having a 3 inch span is raised approximately 0.025 inches at its center. Similarly the inner chordal faces of the pressure tube are pre-formed to match the above curvature.

The corner plate are also pre-formed to the deflected shape of the pressure tube and span the corners of the adjacent chordal lengths to provide a support for the tube when it is pressurized.

In order to operate the clearance control apparatus 46, pressure is applied to the pressure tubes by the common supply pipe 114 and supply pipe 112. The pre-loading and pre-forming the center plates 78 will be deflected radially inwardly to move the segments 42 inwardly against their inner stop thereby reducing the clearance X. Similarly when the pressure in the pressure tubes is released the center plates will move radially outwardly immediately carrying with them their respective segments 42 against the radially outward stop thereby increasing the clearance X.

The clearance X whilst the engine is running at steady state conditions will be minimized, sufficient only to accommodate build tolerances and eccentricities, with the rotor path segments being held against the radially inner stop.

The segments 42 will move to the radially outer stop in direct response to any change in throttle setting, only to return to the inner stop after a pre-determined time lapse when steady state conditions have been re-established.

In a specific example the clearance X at steady state condition is between 0 to 0.015 inches. The clearance X increases by a fixed amount of the order of 0.040 inches to 0.050 inches with a time lapse of the order 30 seconds after an engine acceleration and a time lapse of approximately 1.50 minutes after an engine deceleration. The increase in the clearance X ensures that an adequate clearance is maintained preventing the blade tips rubbing on the shroud during engine transients.

In the preferred embodiment of the present invention the pressure tube 68 is split angularly into six sections, each section having three chordal lengths 74 operating three adjacent segments 42 (FIG. 3). However the tube 68 could range from a full single, complete ring to individual tubes for each chordal length 74. The tube or tubes 68 can be formed by, for example super plastic forming or by die stamping separate inner and outer skins which are brazed or welded together. The operating pressure in the tubes is approximately 20–30 psi greater than the turbine annulus gas pressure.

It will be appreciated that it will not always be necessary to provide a central spring plate 78 and the segments 42 are then attached directly to the chordal lengths 74 of the pressure tube or tubes 68 which have a graduated thickness.

The projections 64 (FIG. 3) are provided with holes through which cooling air can been passed in order to cool the outer surface of the segments 42. Also holes through the upstream wall 56 can be provided for the impingement cooling of the segments 42.

It will be appreciated that a blade tip clearance control apparatus according to the present invention allows the clearance 'X' to be maintained at a minimum by applying pressure to the or all of the pressure tubes 68, causing the segments 42 to move radially inwardly against the inner stop.

As soon as one of the transient conditions occur, the pressure in the or each tube 68 is released, and the segments immediately move radially outward against the outer stop, thereby increasing the clearance 'X' so that contact is avoided. Pressure is only applied again after either a pre-determined time lapse, or steady state conditions are re-established.

If the pressure in the tube or tubes 68 should be released for any reason such as loss of supply pressure or fracture, the segments 42 under the influence of the spring plates 78 will immediately move outwardly to about the outer stop, thereby opening up clearance X to its maximum.

I claim:

1. A gas turbine engine blade tip clearance control apparatus comprising a plurality of circumferentially arranged spaced wall members located adjacent a rotor path of a plurality of blades of the engine, at least one pressure tube for moving each wall member from a first radial stop to a second radial stop, the at least one pressure tube having a plurality of chordal lengths to which the wall members are operationally attached, the chordal lengths being preloaded to hold the wall members against the first radial stop, the pressure tube being pressurizable to deflect the chordal length and move the wall member against the second radial stop.

2. An apparatus as claimed in claim 1, wherein each chordal length is preloaded by being formed as a radiussed arc.

3. An apparatus as claimed in claim 1, wherein a plurality of equi-spaced pressure tubes are circumferentially arranged within a frame, each pressure tube having at least one chordal length and having end supports in the frame located between at lease one chordal length, the wall members being operably connected to the tubes in the region of the chordal lengths.

4. A apparatus as claimed in claim 3, wherein each pressure tube has three spaced chordal lengths.

5. An apparatus as claimed in claim 3, wherein the end support members have an outer surface shaped to conform to the surface of the respective pressure tube when pressure is applied to the interior of the tube.

6. An apparatus as claimed in claim 3, wherein each wall member is attached to a spring plate supported against the respective pressure tube in the region of the respective chordal length by the end supports.

7. An apparatus as claimed in claim 6, wherein each spring plate is preloaded to hold the respective wall member against the first radial stop.

8. An apparatus as claimed in claim 7, wherein each spring plate is preloaded by being formed with a radiussed arc corresponding to the radiussed arc of the chordal length.

9. An apparatus as claimed in claim 1, wherein the first radial stop is radially outermost of the second radial stop.

10. An apparatus as claimed in claim 1, wherein at lease one pressure tube has air supply means connected by a switch for supplying air to a source of pressurized air.

11. An apparatus as claimed in claim 10, wherein the switch is under the control of an engine control system.

12. An apparatus as claimed in claim 3, wherein the frame includes openings to allow cooling air to impinge upon the wall members.

* * * * *